United States Patent [19]

Dyer

[11] 3,953,710

[45] Apr. 27, 1976

[54] COMPACT PORTABLE HAIR DRYER

[75] Inventor: Hugh Edric Trendhard Dyer, Wimborne, England

[73] Assignee: Firth Cleveland Limited, London, England

[22] Filed: July 10, 1974

[21] Appl. No.: 487,136

[30] Foreign Application Priority Data

July 17, 1973 United Kingdom ..... 33946/73

[52] U.S. Cl. ..... 219/370; 34/96; 34/243 R; 219/364; 219/366; 219/373; 417/411

[51] Int. Cl.[2] ..... H05B 1/00; A45D 20/12; F04B 35/04

[58] Field of Search ..... 219/363, 364–372, 219/373–376, 381, 382, 366, 370, 371, 369; 34/96–101, 243 R; 417/411

[56] References Cited

UNITED STATES PATENTS

| | | | |
|---|---|---|---|
| 1,515,731 | 11/1924 | Cole | 219/370 X |
| 2,641,679 | 6/1953 | Brodbeck | 219/370 X |
| 3,152,874 | 10/1964 | Hupka | 34/99 |
| 3,259,996 | 7/1966 | Hull et al. | 219/366 X |
| 3,261,107 | 7/1966 | Pomczek et al. | 219/370 X |
| 3,397,463 | 8/1968 | Laing | 219/370 X |
| 3,788,777 | 1/1974 | Fichter | 417/411 |
| 3,846,047 | 11/1974 | Wada et al. | 219/370 X |

FOREIGN PATENTS OR APPLICATIONS

| | | | |
|---|---|---|---|
| 428,017 | 7/1967 | Switzerland | 219/369 |

*Primary Examiner*—A. Bartis
*Attorney, Agent, or Firm*—Pennie & Edmonds

[57] ABSTRACT

A hair dryer comprises a motor-driven fan mounted in a casing part together with a heating element for heating the air flow generated by the fan and flowing from an air inlet grid structure to an air outlet grid structure on the casing part. This casing part is telescopically mounted within a main casing part whereby the air inlet and outlet grid structures of the first mentioned casing part are covered by the main casing part in the retracted position and are fully exposed in the extended position. A switch controlling the fan and heater element is actuated in response to movement of the first mentioned casing part from the retracted to the extended position of said casing part relative to the main casing part whereby the fan and heater element are energized only in the extended position.

3 Claims, 8 Drawing Figures

COMPACT PORTABLE HAIR DRYER

FIELD OF THE INVENTION

The invention relates to portable motor-driven fan assemblies, for example hair dryers.

SUMMARY OF THE INVENTION

According to the present invention, there is provided a portable motor-driven fan assembly comprising an electric motor, a fan coupled to the motor, a casing formed in two relatively telescopic parts one of which accommodates the fan and motor, and switch means controlling energization of the motor, said switch means being actuable to energize the fan when the two casing parts are moved from a closed to an open configuration, and to de-energize the fan when moved from the open to the closed configuration.

Further according to the invention, there is provided a portable motor-driven hair dryer comprising an electric motor, a fan coupled to the motor, a heater element, a switch connected in a circuit of the fan and heater element, a first casing part accommodating said motor, and a second casing part telescopically receiving the first casing part, said fan, said heater element and said switch, said switch being actuable to energize the fan and heater element when the first casing part is moved out of the second casing part and to de-energize the fan and heater element when the first casing part is retracted into the second part.

Still further according to the invention, there is provided a hair dryer comprising a fan, a motor directly coupled through a flexible coupling to the fan, an electric current supply connection, a heater element, a switch interposed between the circuit of the motor and heater element, a casing part with inlet and outlet openings and carrying the fan and heater element between the openings, a further casing part telescopically receiving the first-mentioned casing part and having an aperture slidably receiving the electric current connection, and the further casing part carrying a cam disposed to actuate the switch as the casing parts are moved relatively to one another.

BRIEF DESCRIPTION OF THE DRAWING

One embodiment of a hair dryer in accordance with the invention will now be described, by way of example only with reference to the accompanying diagrammatic drawing in which.

DESCRIPTION OF THE PREFERRED EMBODIMENT

Figure 1:
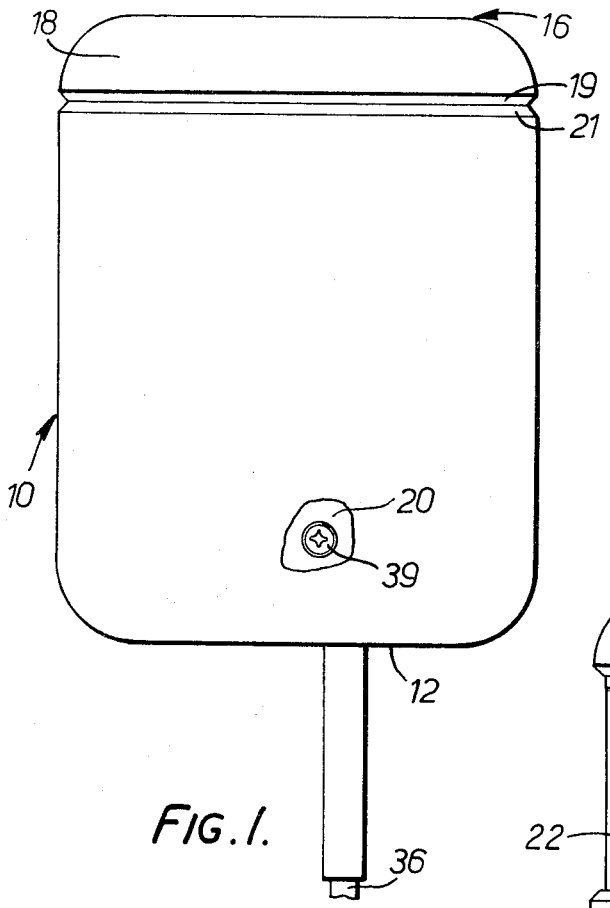
FIG. 1 is an external side elevation of the embodiment showing the hair dryer in an inoperative configuration.
Figure 2:
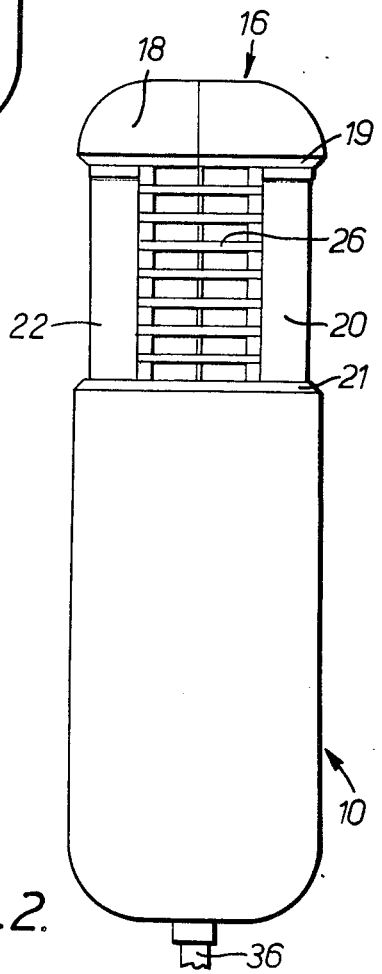
FIG. 2 is an elevation of the hair dryer of FIG. 1 but viewed from another side (at right angles to the first-mentioned side) and showing the hair dryer in another, operative, configuration.
Figure 3:
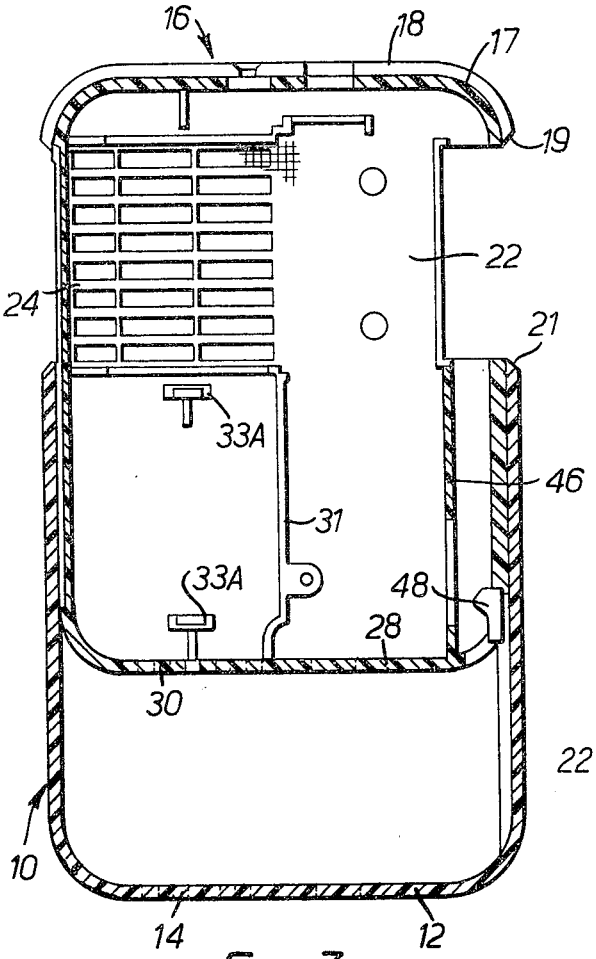
FIG. 3 is a longitudinal section with certain working parts omitted, the dryer being in the same configuration as in FIG. 2.
Figure 4:
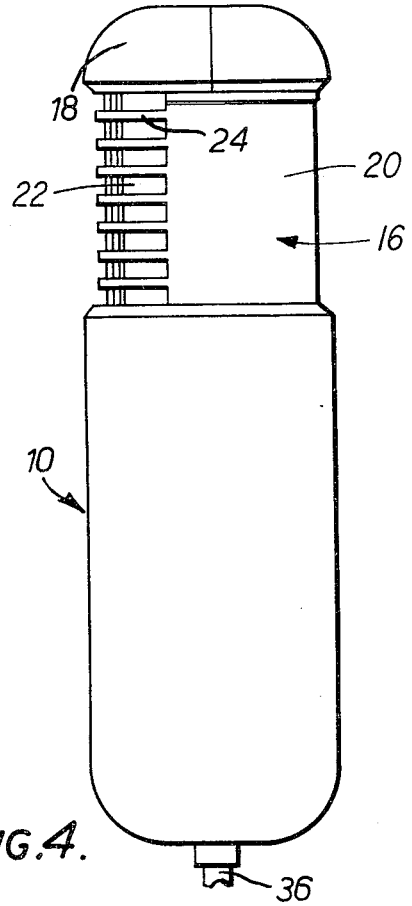
FIG. 4 is a side elevation similar to FIG. 2 but viewed from the opposite side.
Figure 5:
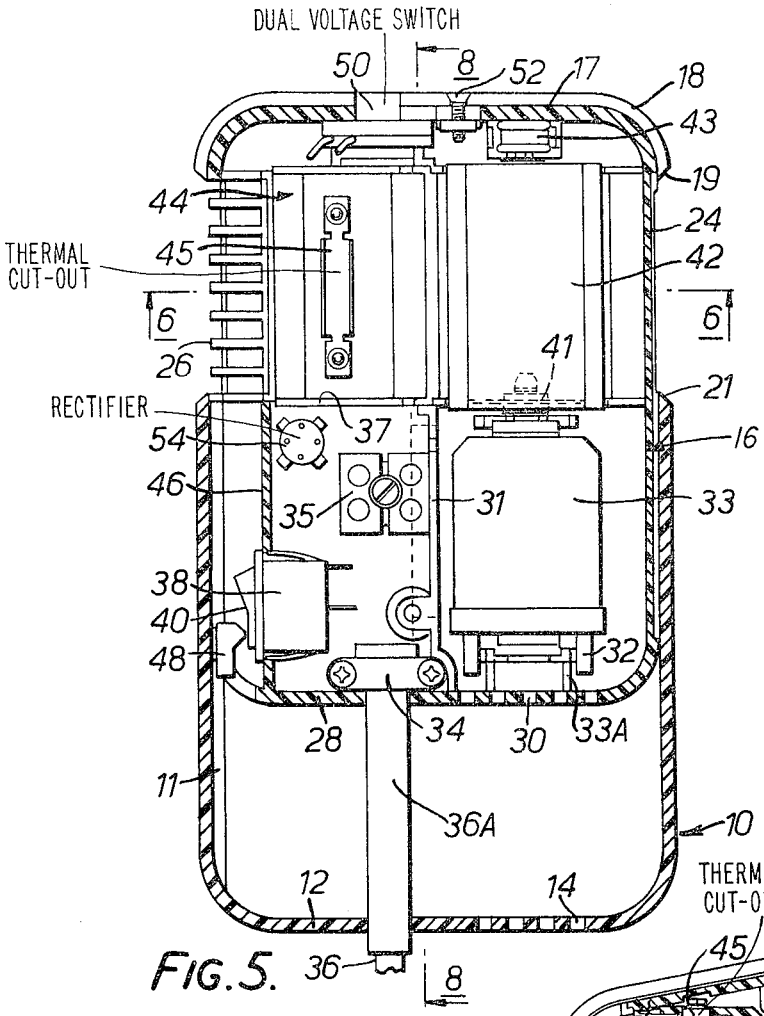
FIG. 5 is a longitudinal section of the embodiment with operational parts in position, the section being viewed from the opposite side to the section of FIG. 3.

Referring now to the drawings, the embodiment now to be described of a hair dryer in accordance with the invention includes a main casing part 10 of plastics material which is generally rectangular, as viewed in FIGS. 1 and 3, and has a closed bottom end wall 12 with a plurality of ventilation perforations 14 (FIGS. 3 and 5). The casing also includes a part 16 which is slidable relatively to and within the casing part 10. The part 16 is made in two moulded plastics halves. Both parts 10 and 16 are of generally wedge cross-section with wellrounded ends (see FIG. 6). The casing part 16 has an upper end wall 17 which carries a well-rounded cap 18, side walls 20, 22 depending from the wall 17, a grid structure 24 for the intake of fresh air and a grid structure 26 for delivery of warmed air. As will be apparent from FIG. 1, the cap 18 has a chamfer 19 which corresponds with and meets a chamfer 21 of the casing part 10.

The intake grid structure 24 includes plane and arcuate section portions (see FIG. 6) and lies between a plane portion of the side wall 22 and an arcuate-section portion of the side wall 20. The outlet grid structure 26 lies symmetrically about the longer axis of a cross-section of the dryer casing and between plane section portions of the walls 20, 22. As is apparent from FIG. 6, the grid 26 is of arcuate cross-section.

The casing part 16, apart from the cap 18, is a free sliding fit within the casing part 10 and has a bottom wall 28 with ventilation perforations 30 immediately adjacent terminals 32 of an electric motor 33. The electric motor 33 is supported on mounting means 33A (see FIGS. 3 and 5) carried by a part of the side wall 22 lying below the grid structure 24. The ventilation perforations 30 are preferably aligned with the perforations 14.

Figure 6:
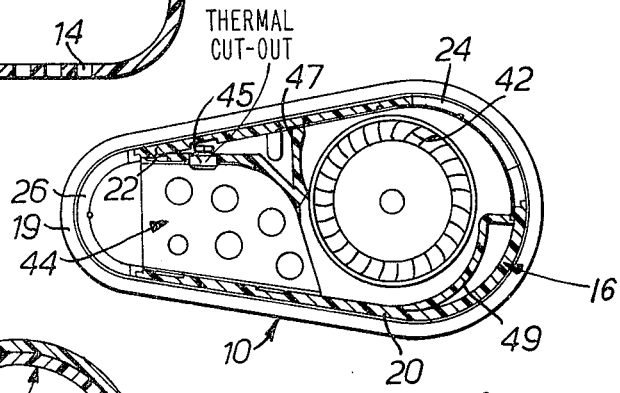
FIG. 6 is a section on the line 6—6 of FIG. 5.

Internally, the casing part 16 carries the cable clamp 34 of an electric input cable 36, a terminal block 35, a switch 38 having a rocker element 40 and a crossflow fan rotor 42 directly coupled to the electric motor 33 by a flexible coupling in the form of a rubber grommet 41. The fan rotor 42 is supported at the end remote from the coupling 41 by a bearing 43 carried by the end wall 17 of the casing part 16. The cable is inserted in a sleeve 36A which is a sliding fit in an aperture in the casing wall 12. As can be seen in FIG. 6, air flow guides 47 and 49 are provided upstream and downstream of the fan rotor 42 and parts of these guides serve to separate the rotor 42 from the motor 33 and other parts of the dryer. The motor 33 is separated from the terminal block 35 and other parts by a partition 31 which is made in two halves, one half extending from each of the side walls 20, 22 and abutting each other approximately centrally of the casing part 16. A transverse partition 37 may be made in two parts each integral with a respective half of the casing part 16 or may, alternatively, be rigid with a heating element subassembly 44. A further partition 46 extends parallel to the partition 31 and carries the switch 38. Screws 39 (FIG. 1) and 52 (FIG. 5) serve to hold the two halves of the casing part 16 together and the latter also holds cap 18 in position.

The fan rotor 42 is positioned to draw in fresh air through the intake grid structure 24 past the guide 47 and to deliver the slightly compressed and accelerated air over the heater element sub-assembly 44 and to deliver the warmed flow of air through the grid 26. As is conventional in heater elements for hair dryers the heater element 44 incorporates a thermal safety cut-out 45. The sub-assembly 44 and cut-out 45 are clamped between the walls 20 and 22.

If desired a dual voltage switch 50 may be provided. The rocker element 40 of the switch 38 is disposed to contact a switch-operating cam 48 rigid with an arcuatesection side wall 11 of the casing part 10. As will be apparent from FIG. 5, as the rocker element 40 moves relative to the cam 48, its position is changed from "on" to "off" or vice versa. As shown in FIG. 5, the switch is in the on position but when the part 16 is retracted into the part 10 the cam 48 actuates the rocker element 40 thus de-energizing the motor and the heating element by changing the switch to the off position. The circuit controlling the motor and the heating element is preferably in accordance with British Pat. No. 1,100,823 and this circuit incorporates a rectifier indicated at 54.

Figure 7:
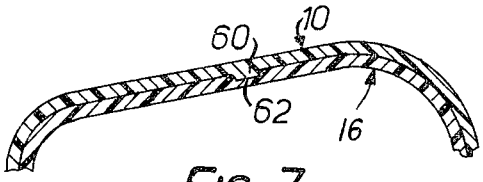
FIG. 7 is a fragmentary section on the line 7—7 of FIG. 8.
Figure 8:
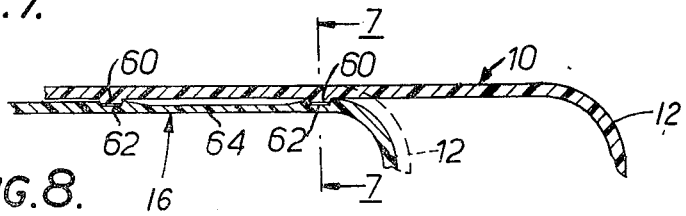
FIG. 8 is a fragmentary section on the line 8—8 of FIG. 5.

In order to avoid the necessity of manufacturing the casing parts 10 and 16 to very close tolerances the casing part 10 may be provided with two projections 60 as shown in FIGS. 7 and 8 which serve alternatively to engage in corresponding notches 62 provided in an integral groove 64 of the casing part 16. It will be apparent that as shown in FIG. 8 the notches 62 and projections 60 are both engaged when the dryer is in its operative position as shown in FIG. 5 whereas, when the part 16 is retracted into the part 10 only one of the notches 62 is engaged by one of the projections 60. However, when the dryer is in the retracted position the single engagement is adequate to ensure stability of the assembly. As will be seen in FIG. 8, the groove 64 in longitudinal section has a very shallow channel shape intermediate the notches 62. As will be apparent from FIG. 8 the notches 62 are so dimensioned that the parts cannot be fully disengaged by any attempt at relative movement beyond the operating position. The notches 62 and projections 60 can, if preferred, be replaced by a rib (or ribs) which extends around the inside of the casing part 10 or around the outside of the casing part 16 where is is in permanent contact with the part 10. The rib or ribs may be interrupted and may be chamfered to assist assembly.

In further modifications, the notches 62 and projections 60 are replaced by a circumferential O-ring interposed between the casing parts, by lengthwise extending ribs or by one or more lengthwise extending resilient pads.

Operation is extremely simple. To operate the dryer the user pulls the casing part 16 out of the part 10 by gripping and pulling the cap 18. The cam 48 flips the rocker 40 to the on position and the motor and heating elements are energized. Conversely the reverse movement pushes the rocker to the off position so that the motor and heating element is de-energized. The cam 48 and notches 62 and projections 60 serve to prevent complete disengagement of the casing parts 10 and 16.

It will be appreciated that the cross-flow fan can be replaced by one or more centrifugal, axial or radial fans and that although the preferred embodiment is intended to work from mains electricity, by suitable switching, it may be possible to operate the dryer from a suitable battery, such as a motor car battery.

The heating elements of the sub-assembly 44 may be of any appropriate type for example card elements.

What is claimed is:

1. A hair dryer comprising a main casing part, a further casing part telescopically, rectilinearly slidable between a retracted end position and an extended end position in said main casing part, and having an ambient air inlet opening grid structure, and an outlet opening grid structure, the air inlet and outlet grid structures of the further casing part being fully covered by the main casing part in the retracted end position, and fully exposed in the extended end position, a fan mounted in the further casing part arranged to draw in air through the said inlet opening grid structure and discharge air through the outlet opening grid structure, an electric heater element mounted in the further casing part between the fan and the outlet opening grid structure, a thermal cut-out device in said further casing part between the fan and the outlet opening grid structure, and connected in circuit with the heater element, an electric motor mounted within the further casing part, a coupling operatively connecting the motor and the fan for rotation of the fan, a switch mounted in the further casing part and electrically-connected both to the heater element, the thermal cut-out device, the motor and a mains cable, means mounted on the main casing part for actuating the switch in response to relative movement between said casing parts to energize the electric motor and the electric heater element as the casing parts are slid relative to one another to the extended end position and to de-energize the electric motor and electric heater element as the casing parts are slid relative to one another to the retracted end position, and means for clamping the mains cable in the further casing part for movement therewith.

2. A hair dryer according to claim 1, wherein the main casing part carries a pair of internal projections and the further casing part has a pair of notches, both of the notches and projections being in engagement when the dryer is in the extended end position and only one notch engaging one projection when the parts are in the retracted end position.

3. A hair dryer according to claim 1, wherein the coupling between the motor and fan is flexible.

* * * * *